US007628658B1

(12) United States Patent
Chiang

(10) Patent No.: US 7,628,658 B1
(45) Date of Patent: Dec. 8, 2009

(54) PLUG CONNECTOR

(75) Inventor: Shu-Man Chiang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/205,253

(22) Filed: Sep. 5, 2008

(51) Int. Cl.
*H01R 9/22* (2006.01)

(52) U.S. Cl. ..... 439/709

(58) Field of Classification Search ..... 439/510–513, 439/709, 350–358, 607, 731, 906, 188, 607.01
See application file for complete search history.

(56) References Cited

U.S. PATENT DOCUMENTS 5,071,362 A * 12/1991 Martens et al. ..... 439/188
5,538,434 A * 7/1996 DelGuidice et al. ..... 439/188
6,976,876 B1 * 12/2005 Su et al. ..... 439/607

* cited by examiner

*Primary Examiner*—Edwin A. Leon

(57) ABSTRACT

A plug connector includes an insulating housing and a plurality of contacts received in the insulating housing. The insulating housing has a base body and a tongue portion extending rearward from the base body. The tongue portion has a top portion and a bottom portion. Each of the contacts has a substantially U-shaped contacting portion which includes a first contacting branch, a second contacting branch substantially parallel to the first contacting branch and a connecting portion connected one end of the first and second contacting branches together. The first and the second contacting branches of the contacts are respectively exposed at the top and bottom portions of the tongue portion for both electrically contacting terminals of a complementary receptacle connector.

9 Claims, 3 Drawing Sheets

PLUG CONNECTOR

BACKGROUND OF THE INVENTION

1. Field of the Invention

The present invention relates to an electrical connector, and more particularly to a plug connector having improved contacts.

2. The Related Art

In general, a plug connector is adapted to electrically connect with a complementary receptacle connector for transmitting signals therebetween. The plug connector includes an insulating housing and a plurality of contacts received in the insulating housing. The receptacle connector includes an insulator and a plurality of terminals disposed in the insulator. When the receptacle connector is mated with the plug connector, the terminals are electrically connected with the contacts to transmit the signals.

However, the terminal of the receptacle connector contacts with only one side of the contact of the plug connector to achieve electrical connection therebetween. Though the connection structure between the terminals and the contacts is simple, it may cause unsteady connection between the terminals and corresponding contacts, and as a result, the terminals of the receptacle connector and the contacts of the plug connector would more likely be disconnected from each other when the assembly thereof is accidentally subject to an external force, then the assembly cannot transmit signal stably.

SUMMARY OF THE INVENTION

An object of the present invention is to provide a plug connector having improved contacts and capable of being stably mated with a complementary receptacle connector. The plug connector includes an insulating housing and a plurality of contacts received in the insulating housing. The insulating housing has a base body and a tongue portion extending rearward from the base body. The tongue portion has a top portion and a bottom portion. Each of the contacts has a substantially U-shaped contacting portion which includes a first contacting branch, a second contacting branch substantially parallel to the first contacting branch and a connecting portion connecting one end of the first and second contacting branches together. The first and second contacting branches are respectively exposed at a top and bottom portions of the tongue portion. The connecting portion is disposed in a rear end of the tongue portion opposite to the base body. Both of the first and the second contacting branches of the contacts of the plug connector can electrically contact terminals of a complementary receptacle connector when the receptacle connector is mated with the plug connector.

As described above, because both of the first and the second contacting branches of the contacts electrically are connected with the terminals, so that the connection therebetween will be stable. It avoids the terminals from disconnecting the contacts when the assembly of the receptacle and plug connector suffers from an outside force, so that the signals can be transmitted reliably between the receptacle connector and the plug connector.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
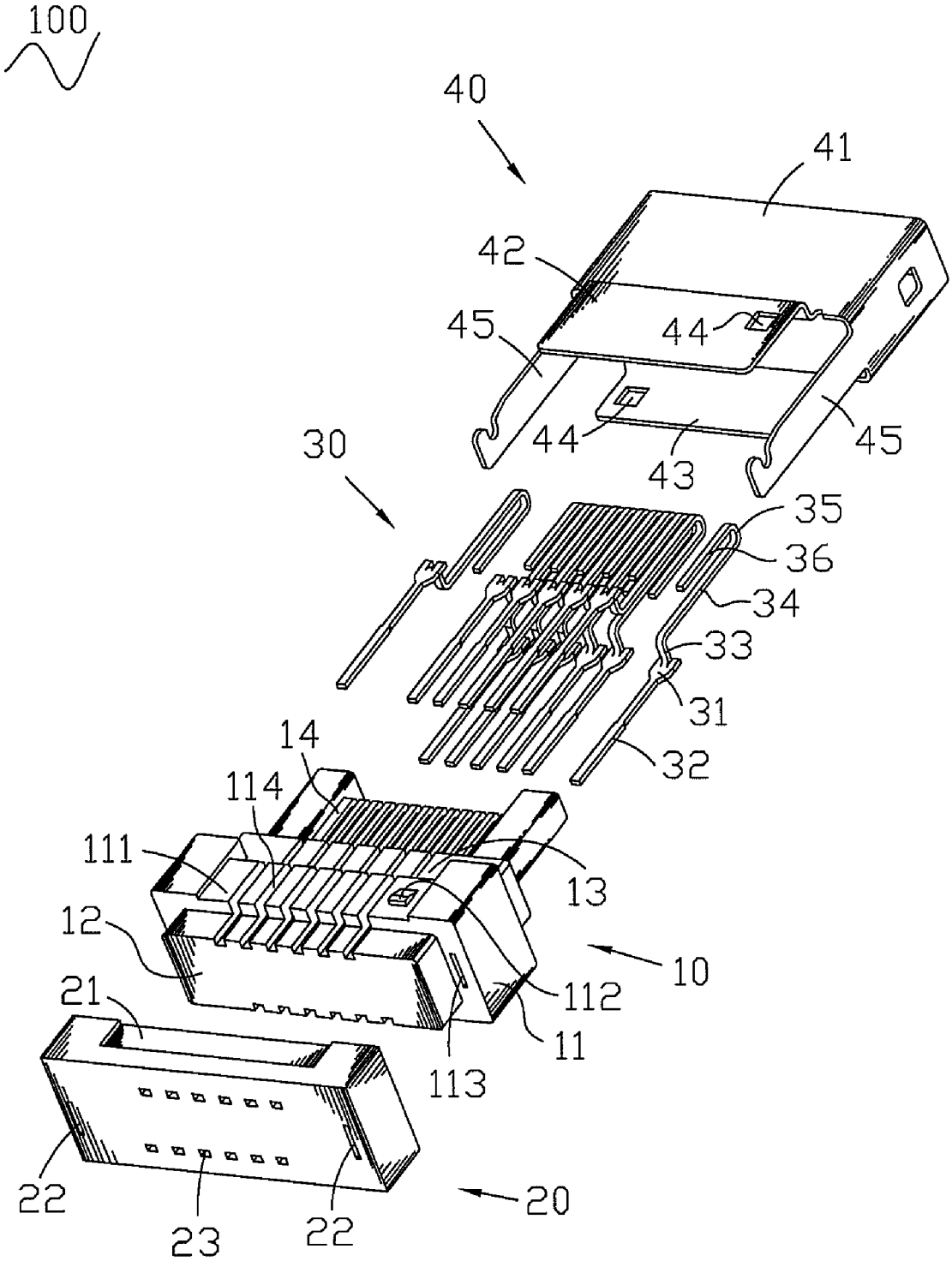
FIG. 1 is an exploded view of a plug connector according to the present invention.

Please Refer to FIG. 1, a plug connector 100 according to the invention includes an insulating housing 10, a cover 20, a plurality of contacts 30 and a shell 40.

The insulating housing 10 has a substantially rectangular base body 11. The base body 11 defines a butt portion 12 protruding forward from a front surface thereof and a tongue portion 14 extending rearward from a rear surface thereof. Two guide portions 13 project rearward from the rear surface of the base body 11 with one of which located over a front position of a top surface of the tongue portion 14 and the other one located under a front position of a bottom surface of the tongue portion 14. In this case, the base body 11, the guide portions 13 and the tongue portion 14 corporately form a substantially stair-shaped structure therebetween. A top and bottom surfaces of the base body 11 respectively define an opening 111 passing therethrough and a substantially wedge-shaped lump 112 disposed in the opening 111. The base body 11 defines two slots 113 penetrating therethrough and adjacent to two opposite sides thereof respectively.

Figure 2:
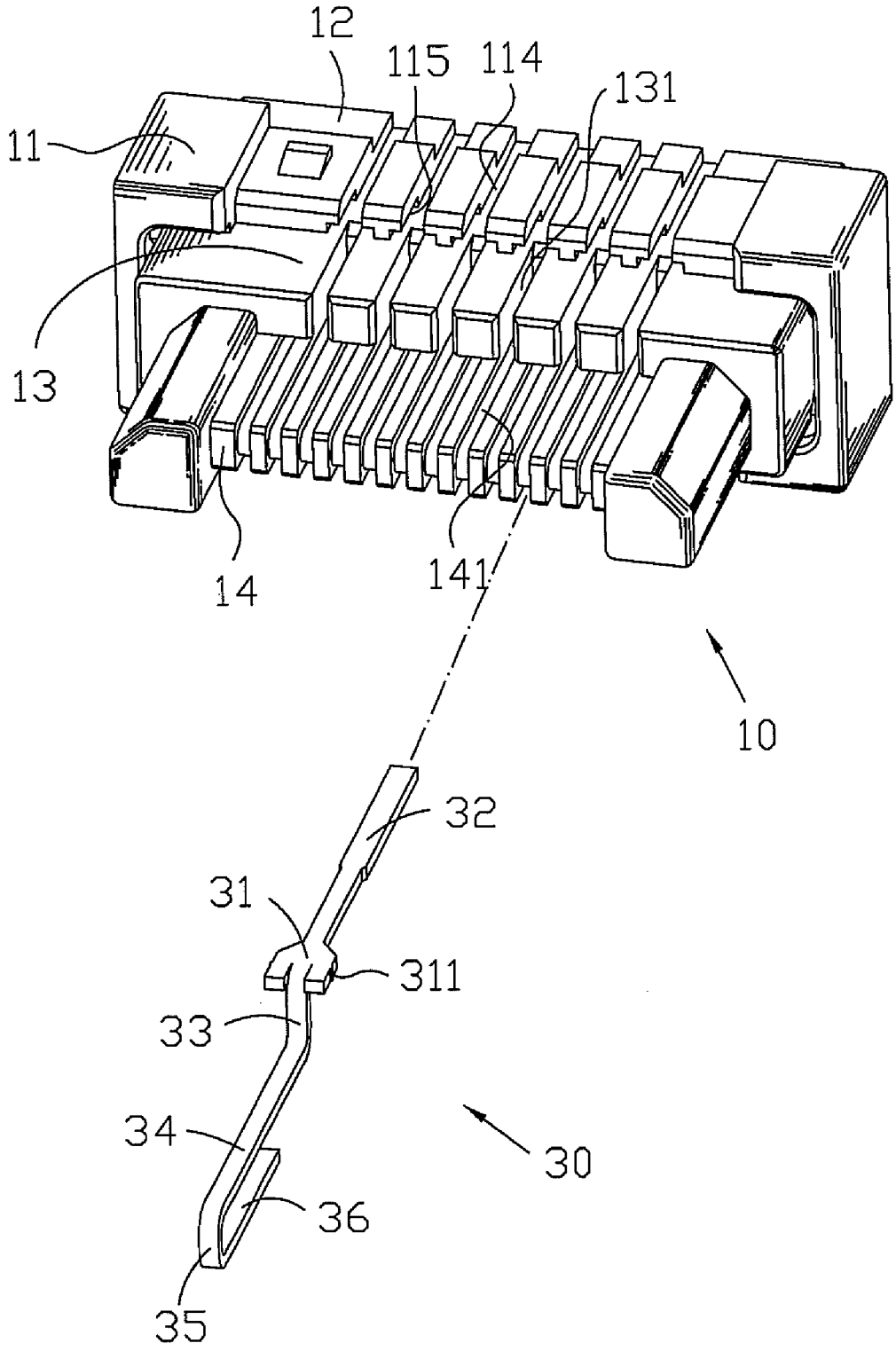
FIG. 2 is a perspective view showing an insulating housing and a contact of the plug connector before the contact assembled to the insulating housing.
Figure 3:
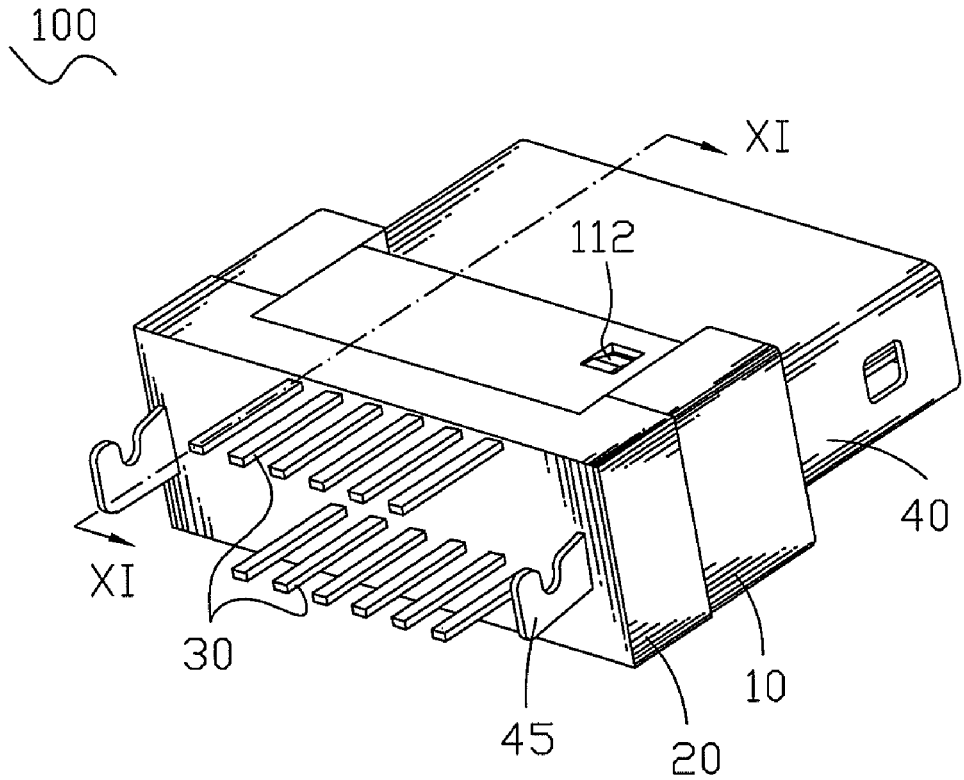
FIG. 3 is an assembly view of the plug connector as shown in FIG. 1.
Figure 4:
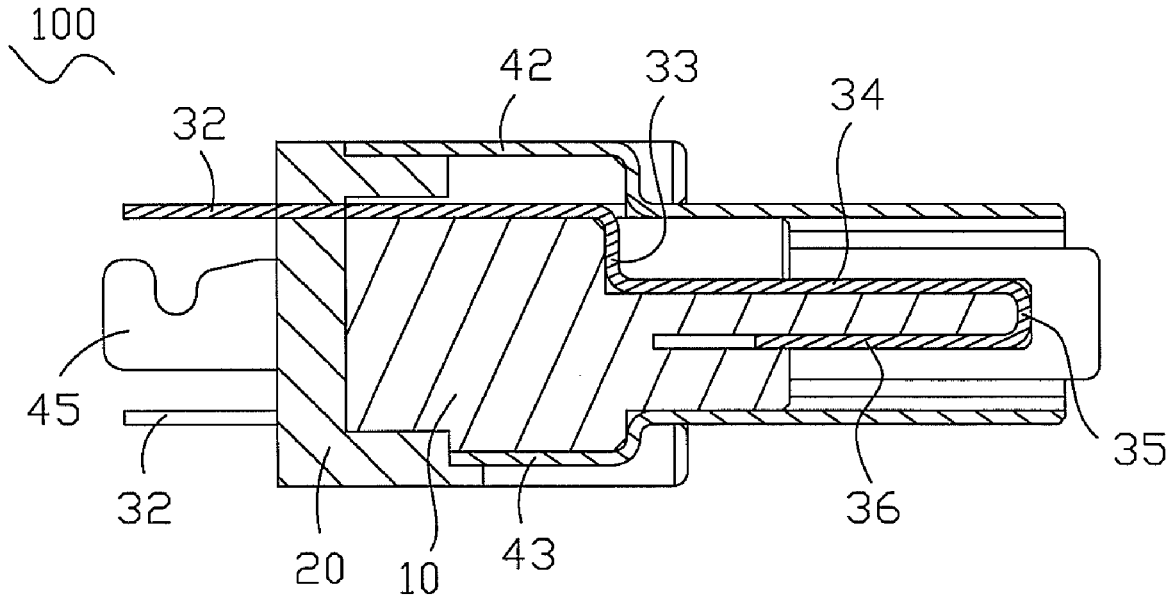
FIG. 4 is a cross-sectional view of the plug connector taken along line XI-XI of FIG. 3.

The base body 11 of the insulating housing 10 further defines two rows of grooves 114 respectively located in the openings 111 and extending into a top and bottom surfaces of the butt portion 12. As best shown in FIG. 2, two opposing sides of each groove 114 respectively extend sideward at a front end thereof to form a fixing trough 115. Both of the two guide portions 13 define a row of channels 131 corresponding to the grooves 114. The tongue portion 14 defines a plurality of substantially U-shaped passageways 141 separated from each other and communicating with the channels 131, so that the U-shaped passageways 141, the channels 131 and the grooves 114 collectively combine to receive the contacts 30 therein.

The cover 20 is of rectangular shape and a top surface thereof defines a substantially rectangular notch 21 transversely penetrating through a rear end of the top surface of the insulating cover 20. A receiving cavity (not shown) is defined at a rear surface of the insulating cover 20 for receiving the butt portion 12 of the insulating housing 10 therein. The cover 20 defines a pair of slits 22 penetrating therethrough and adjacent to two opposite sides thereof. Two rows of through-holes 23 are defined between the two slits 22 and connecting with the receiving cavity.

The contacts 30 are symmetrically disposed in the insulating housing 10. Each of the contacts 30 has a fixed portion 31 which defines a projecting thorn 311 at two opposite sides thereof respectively. An extending portion 32 extends forward from a front end of the fixed portion 31. A middle portion of a rear end of the fixed portion 31 extends upward to form a bending portion 33. A substantially U-shaped contacting portion connected with the bending portion 33 includes a first contacting branch 34 extending rearward from a free end of the bending portion 33, a second contacting branch 36 spaced apart from and substantially parallel to the first contacting branch 34 and a connecting portion 35 connecting one end of the first and second contacting branches 34, 36 together.

The shell 40 has a hollow receiving portion 41. The top and the bottom of the receiving portion 41 respectively bend upward and downward slightly and then extend forward at front ends thereof to form an upper shelter board 42 and a lower shelter board 43. Both of the upper and the lower shelter boards 42, 43 define a location hole 44. A pair of extending arms 45 respectively extends forward from front ends of two opposite sides of the receiving portion 41.

Referring to FIGS. 1-4. In the assembly, the butt portion 12 of the insulating housing 10 is received in the receiving cavity of the insulating cover 20. In this case, the opening 111 and the notch 21 are combined together. The slots 113 and the slits 22 are connected with each other. The grooves 114 are connected to the through-holes 23. Then, the contacts 30 are assembled to the insulating housing 10. The fixed portions 31 slide on the guide portions 13 until the fixed portions 31 are fixed in the fixing troughs 115 while the projecting thorns 311 of the fixed portions 31 are tightly against opposite sides of the fixing troughs 115. In this case, the U-shaped contacting portions are received in the U-shaped passageways 141 with the first and second contacting branches 34, 36 exposed at the top and bottom surfaces of the tongue portion 14 and the connecting portions 35 disposed in a rear end of the tongue portion 14. The bending portions 33 are received in the channels 131. The extending portions 32 are partly received in the grooves 114 and free ends thereof pass through the through-holes 23 and horizontally extend out of the cover 20. The shell 40 is coupled with the insulating housing 10. The upper and the lower shelter boards 42, 43 are received in the openings 111 and a front end of the upper shelter board 42 further extends in the notch 21. The wedge-shaped lumps 112 are correspondingly fixed into the location holes 44. The extending arms 45 pass through the slots 113 of the insulating housing 10 and the slits 22 of the cover 20 and extend out of the insulating cover 20.

As the above description, because of the first and the second contacting branches 34, 36 of the contacts 30 exposed at the top and bottom surfaces of the tongue portion 14, when a complementary receptacle connector is mated with the plug connector 100, terminals of the receptacle connector are electrically connected with both the first and the second contacting branches 34, 36, which ensures the terminals to contact the contacts 30 more stably. Then it can avoid the terminals of the receptacle connector from disconnecting the contacts 30 of the plug connector 100 when the assembly thereof is impacted by an external force, so that signals can be transmitted reliably between the receptacle connector and the plug connector 100.

What is claimed is:

1. A plug connector, comprising:

an insulating housing having a base body and a tongue portion extending rearward from the base body, the tongue portion having a top portion and a bottom portion; and a plurality of contacts received in the insulating housing, each of the contacts having a substantially U-shaped contacting portion which includes a first contacting branch, a second contacting branch substantially parallel to the first contacting branch and a connecting portion connecting one end of the first and second contacting branches together, the first and second contacting branches respectively being disposed in the top and bottom portions of the tongue portion for being exposed outside, the connecting portion being disposed in a rear end of the tongue portion opposite to the base body, wherein the contact further comprises a fixed portion fixed in the base body of the insulating housing and an extending portion exposed partially out of the base body, wherein the other end of the first contacting branch of the contacting portion bends towards an opposite direction with the connecting portion to form a bending portion connected with one end of the fixed portion, the other end of the fixed portion extending opposite to the contacting portion to form the extending portion substantially parallel with the first contacting branch of the contacting portion.

2. The plug connector as claimed in claim 1, wherein the tongue portion defines a plurality of substantially U-shaped passageways for correspondingly receiving the contacting portion of the contact.

3. The plug connector as claimed in claim 1, wherein the base body defines a plurality of grooves at a top surface thereof for receiving the fixed portions and the extending portions of the contacts therein, free ends of the extending portions extending out of the grooves, two opposing sides of each groove extending sideward to form a fixing trough for fixing the fixed portion therein.

4. The plug connector as claimed in claim 3, wherein two opposite sides of the fixed portion respectively define a projecting thorn pressing against two opposite sides of the fixing trough.

5. The plug connector as claimed in claim 3, wherein the base body extends rearward to form a guide portion located over a front of the tongue portion, the guide portion defining a plurality of channels corresponding to the grooves for allowing the bending portions of the contacts entering from a rear thereof and arriving at a front thereof, the fixed portions of the contacts sliding on the guide portion until the fixed portions are fixed in the corresponding fixg troughs.

6. A plug connector adapted for mating with a receptacle connector having a plurality of terminals therein, comprising:

an insulating housing having a base body and a tongue portion extending rearward from the base body, the tongue portion having a top portion and a bottom portion; and a plurality of contacts received in the insulating housing, each of the contacts having a substantially U-shaped contacting portion which includes a first contacting branch, a second contacting branch substantially parallel to the first contacting branch and a connecting portion connecting one end of the first and second contacting branches together, the first and second contacting branches respectively being disposed in the top and bottom portions of the tongue portion and being exposed outside for contacting with the corresponding terminals of the receptacle connector so as to form an electrical connection between the plug connector and the receptacle connector, the connecting portion being disposed in a rear end of the tongue portion opposite to the base body.

7. The plug connector as claimed in claim 6, wherein the tongue portion defines a plurality of substantially U-shaped passageways for correspondingly receiving the contacting portion of the contact.

8. The plug connector as claimed in claim 6, wherein the contact further comprises a fixed portion fixed in the base body of the insulating housing and an extending portion exposed partially out of the base body.

9. The plug connector as claimed in claim 8, wherein the other end of the first contacting branch of the contacting portion bends towards an opposite direction with the connecting portion to form a bending portion connected with one end of the fixed portion, the other end of the fixed portion extending opposite to the contacting portion to form the extending portion substantially parallel with the first contacting branch of the contacting portion.

* * * * *